United States Patent [19]

Maurin

[11] 3,950,581

[45] Apr. 13, 1976

[54] MANUFACTURE OF PREFABRICATED PANELS

[75] Inventor: Aristide Maurin, Creteil, France

[73] Assignee: Manufacture Francaise des Chaussures "Eram", Saint Pierre-Montlimart, France

[22] Filed: July 12, 1974

[21] Appl. No.: 487,986

Related U.S. Application Data

[63] Continuation-in-part of Ser. No. 456,221, March 29, 1974.

[30] Foreign Application Priority Data

Mar. 30, 1973 France ..... 73.11673

[52] U.S. Cl. ..... 428/49; 52/309; 264/261

[51] Int. Cl.[2] ..... B32B 3/14; B32B 3/16

[58] Field of Search ..... 161/36, 37; 52/309; 264/261

[56] References Cited

UNITED STATES PATENTS

| | | | |
|---|---|---|---|
| 2,917,801 | 12/1959 | Fitzgerald | 264/261 |
| 3,125,831 | 3/1964 | Marsch et al. | 264/261 |
| 3,185,748 | 5/1965 | Macdonald et al. | 264/261 |
| 3,192,567 | 7/1965 | Abernethy et al. | 264/261 |
| 3,239,981 | 3/1966 | Fitzgerald | 52/309 |

*Primary Examiner*—William E. Schulz

*Attorney, Agent, or Firm*—Millen, Raptes & White

[57] ABSTRACT

The invention relates to the manufacture of prefabricated panels from tiles, for example of sandstone, earthenware, metals, wood or rubber, the tiles being joined by a composition consisting of a heat-cured mixture of a substantially stoichiometric mixture of an epoxy resin and certain resins containing functional groups reactive therewith, and a polymer selected from polyvinyl chloride, polyvinyl acetochloride and nitrile rubber. Panels in accordance with the invention can be laid rapidly without the problems encountered with conventional methods in which the bonding agent between the tiles must be left to harden before loads are applied to the tiles.

6 Claims, 3 Drawing Figures

MANUFACTURE OF PREFABRICATED PANELS

This invention relates to the production of composite materials, in particular the manufacture of prefabricated floor tiling, and it is a continuation-in-part of my application Ser. No. 456,221, filed Mar. 29, 1974.

Hitherto, tiling of various materials such as sandstone, earthenware, ceramic, glazed ceramic, aluminum, stainless steel etc. has been laid by a so-called "conventional" method. Architects and tile-layers are familiar with the difficulties and inconvenience of this conventional method. The tiling is delivered glued at regular intervals to a sheet of Kraft paper, and these assemblies are applied with the tiling side next to a laying bed or to a cement coating which is still fresh. It is then necessary to wait several days before removing the paper by washing with a brush. Subsequently, a wash of white cement has to be applied in order to fill the gaps between the tiles and to obtain a tight joint. Throughout this period, walking on the tiling inevitably leads to deformations which subsequently become apparent as irregularities in the surface, and breaks occur in the tiles, due to pressure (from the feet of furniture or chairs, for example) or internal stress (bilaminar effect).

It is an object of the present invention to overcome these inconveniences.

According to the present invention there is provided a process for the production of a composite material for covering a surface, in which process tiles are placed in a mold having a lid which cooperates with the mold to act as a piston therein; a joining mixture is applied to the tiles, the joining mixture comprising from 1 to 10% by weight of a substantially stoichiometric mixture of at least one epoxide resin, and at least one resin selected from the group consisting of phenolic, polyamide, polyamine, polyisocyanate, dicyanodiamine and acrylic resins, and from 10 to 50% by weight of at least one polymer selected from the group consisting of polyvinyl chloride, polyvinyl acetochloride and nitrile rubber; closing the mold with the lid to rest on the joining mixture; and heating the mold to a temperature of from about 150° to 200°C for a period of from 5 to 30 minutes while the piston presses on the joining mixture to bring it between the tiles and into the peripheral region therearound to form a peripheral joint and a support layer of cured joining mixture.

The present invention further provides a composite material for covering a surface, the material being the product of joining tiles on a support, the tiles being joined by a thermoset, cross-linked thermo-self-adhesive joining mixture containing 1 to 10% by weight of a substantially stoichiometric mixture of at least one epoxide resin, and at least one product selected from the group consisting of phenolic, polyamide, polyisocyanate, dicyanodiamine and acrylic resins, and 10 to 50% by weight of at least one polymeric material selected from the group consisting of polyvinyl chloride, polyvinyl acetochloride and nitrile rubber.

In accordance with the present invention, the word "tile" is to be understood in a very wide sense. These "tiles" are portions of inert materials, such as, for example, sandstone, treated earthenware, metal alloys, stainless steel, wood or synthetic rubber, and they may be of any shape. Non-limiting examples are circular, triangular, rectangular and square shapes. Preferably the tiles are positioned so that the material in accordance with the invention presents a surface with a pleasant decorative effect.

The support consists of at least one layer of a bonding agent or joining material. If desired, a supplementary support can be used in the form of a sheet or plate, for example a polyvinyl chloride sheet, a metal sheet (metal or metal alloy) or a sheet of cork or felt or a honeycomb material (provided the latter is capable of resisting the temperatures to which they are subjected during curing of the joining material), or a wire cloth or fabric or glass fibre. Several superimposed supplementary supports can be used, each separated by a preferably thin layer of joining material. Furthermore, two layers of tiles can be used to form opposite surfaces of the material, these layers being joined together by the joining material, optionally with a support therebetween of a support material such as hereinbefore defined. In this way, "sandwich panels" can be obtained which have a structure which may be varied as desired.

Cross-linking reactions between phenolic, polyamide, polyisocyanate, dicyanodiamine and acrylic resins, and epoxide resins are known. Each molecule of epoxide resin usually contains at least two active radicals which can react with radicals in the molecules of the other resin. A substantially stoichiometric mixture of epoxide resin and the resin is obtained when the epoxide resin reacts with all the reactive radicals in the other resin. While a less than stoichiometric amount of epoxide resin is acceptable, it is of little advantage to use an excess of epoxide resin.

If it is desired to use a supplementary support, a sheet such as, for example, of polyvinyl chloride, can be placed on the joining mixture before the mold is closed.

The thermo-self-adhesive joining mixture is advantageously present as a plastisol, that is to say as a fluid. However, pre-gelled thermo-adhesive mixtures can be used, these being solid at normal temperature, and easily handled and stored. They are of particular interest when the final material is non-uniformly distributed over the assembly and between the tiles during reaction in the hot, as can occur with a plastisol.

The thermo-self-adhesive joining mixtures comprise at least 1 to 10% by weight by a substantially stoichiometric mixture of at least one epoxide resin, such as an Epikote resin, and at least one phenolic (monophenolic or diphenolic), polyamide, polyisocyanate, dicyanodiamine or acrylic resin, such that the epoxide resin contains substantially the same number of reactive functional groups as the phenolic, polyamide, polyisocyanate, dicyanodiamine or acrylic resin.

Epikote resins are used with advantage as the epoxide resin, these being well known to those skilled in the art. They are chiefly obtained by reacting a diphenol or bisphenol with epichlorohydrin.

The thermo-self-adhesive joining mixture also contains from 10 to 50% by weight of at least one of the polymers, polyvinyl chloride (PVC), polyvinyl acetochloride and nitrile rubber. Mixtures of these polymers can be used, particularly mixtures of polyvinyl chloride and polyvinyl acetochloride, the polyvinyl acetochloride then preferably representing less than 50% by weight of this mixture of two polymers. The term "polyvinyl acetochloride" is used herein to refer to copolymers of vinyl chloride and vinyl acetate containing not more than about 20 to 25% by weight of vinyl acetate.

The other components of the thermo-autoadhesive mixture can be various known additives such as plasticisers, pigments, fillers and flameproofing substances.

These additives can be used in various proportions, for example as are known to those familiar with the technology of plastics materials, and, more particularly, with plastisols.

Composite materials in accordance with the invention can be manufactured in the form of panels having simple geometric shapes which can be placed alongside one another in order to obtain a variety of covers. One surface of these panels is formed by the tiles which are placed in a certain configuration and surrounded by the joining mixture. This surface can be completely plain due to the use of a thermo-adhesive joining mixture of adequate viscosity, so that this mixture can completely fill gaps initially left between the tiles, without "oozing" onto the surface of the tiles. The other surface is usually formed either by a layer of the joining material, or by a supplementary support such as is hereinbefore described. Around each tile is a peripheral joint of the joining material.

If it is desired to arrange the "tiles" to a given geometry, it is advantageous to fix the "tiles" in the mold according to this geometry during manufacture. Several methods can be used, a simple method being to glue the tiles to a support, such as cardboard, and to place the support and glued tiles into the mold.

Composite materials in accordance with the present invention generally have the following advantages:

- the tiles can be flame-proof;
- the material resulting from curing of the thermo-self-adhesive joining mixture provides washable joints, the color of the joint resulting from the choice of pigment used in the joining mixture;
- a supplementary support of an asbestos-coated thermoplastics sheet PVC facilitates rapid and not particularly difficult adhesion directly to a compressed tiling or other smooth shape or surface, using bitumen.

The manufacture of such panels can be rapid, the use of expensive special adhesives is unnecessary.

The good adhesion of the joining mixture following curing enables panels of tiles to be obtained which consist of very different materials such as earthenware, ceramic, glass, aluminum, stainless steel, and glazed ceramic.

For a fuller understanding of the present invention, reference is made to the accompanying diagrammatic drawings in which.

Figure 1:
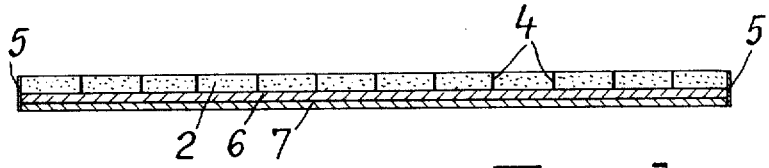
FIG. 1 is a section through a composite material in accordance with the invention in the form of a panel.
Figure 2:
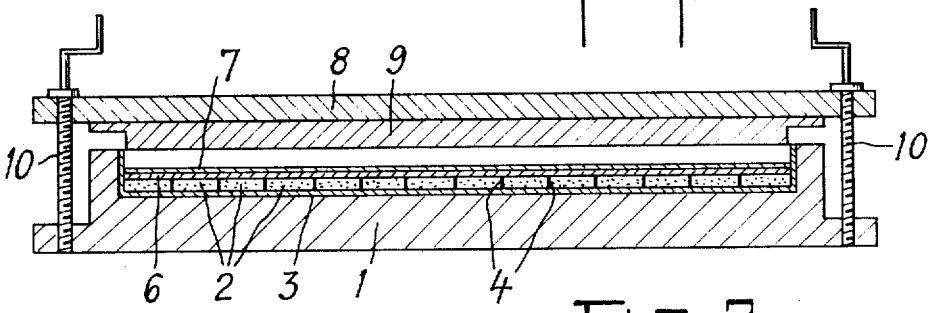
FIG. 2 is a section through a mold for carrying out a process in accordance with the invention.
Figure 3:
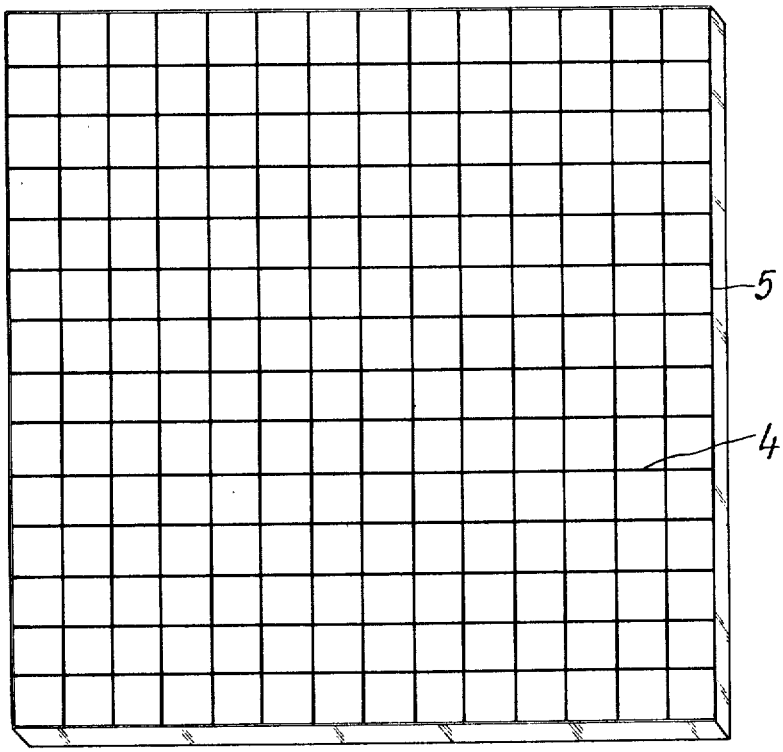
FIG. 3 is a top view of FIG. 1.

In a lower part 1 of a mold are placed tiles 2 previously glued to a cardboard sheet 3. Spaces 4 are left between the tiles. A layer 6 of thermo-self-adhesive joining material fills the spaces 4 and forms a peripheral joint 5 (FIG. 1). A support plate, for example of cork or asbestos-coated polyvinyl chloride, is shown at 7. The mold is closed by a lid 8, portion 9 of the lid forming a piston in the lower part 1. Screws 10 enable the lid of the mold to be pressed against the support 7.

The following non-limitative Examples illustrate the invention. All percentages are by weight unless otherwise indicated.

EXAMPLE 1

This example describes the manufacture of a 300 × 300 mm panel consisting of sandstone tiles.

The thermoplastic joining material contained 35% of polyvinyl chloride, 3% of an Epikote resin, and 3% of phenolic resin 49.58.

The composition of the thermoplastic plastisol joining mixture was as follows:

| | |
|---|---|
| Powdered polyvinyl chloride | 35% |
| Dioctyl phthalate | 15% |
| Dioctyl adipate | 5% |
| Flame-proofing plasticiser (chlorinated paraffins) | 5% |
| Antichlor stabiliser | 15% |
| Flame-proofing filler | 16% |
| Epikote resin type 828 or 815 (SHELL) | 3% |
| Phenolic resin 49.58 | 3% |

The sandstone tiles, previously glued at regular intervals to a thin sheet of rigid cardboard, were placed on the bottom of a mold. The space between the tiles was 1.60 mm. The cardboard sheet was 300 × 300 mm. Around the periphery of the cardboard was a clearance of 0.80 mm, so that a peripheral joint was obtained during molding. The cardboard side was at the bottom of the mold, and the sandstone side was provided with a layer of the thermo-self-adhesive joining mixture. The weight of mixture was 300 to 400 g for each 300 × 300 mm panel.

The mold was then closed with a lid which formed a piston and pressed the thermo-self-adhesive joining mixture to distribute the mixture in the free space between the tiles and over the upper part of the tiles to form a layer of the mixture.

The sealed mold was then heated for 18 minutes by a circulation of oil at a temperature of 180°C. After cooling, the product was released from the mold.

In such a method, it is important to prevent sticking of the thermo-self-adhesive joining material to the walls of the mold with which it comes into contact. For this purpose known processes can be used such as, for example, the use of non-stick coatings (tetrafluoroethylene-silicone) on the walls of the mold or the use of a stripping additive.

EXAMPLE 2

Example 1 was repeated except that a supplementary support was used consisting of a sheet of asbestos-coated polyvinyl chloride which was placed on the thermo-self-adhesive joining mixture before the mold was closed. In addition, a mixture of polvinyl chloride and polyvinyl acetate was used as the polymeric material in the thermo-self-adhesive joining mixture.

Curing was carried out at 180°C for 18 minutes.

The following thermo-self-adhesive joining mixtures were used:

TABLE I

| | I (%) | II (%) | III (%) | IV (%) |
|---|---|---|---|---|
| Powdered polyvinyl chloride (emulsion type) | 30 | 25 | 20 | 15 |
| Polyvinyl acetochloride copolymer | 5 | 10 | 15 | 20 |
| Dioctyl adipate | 5 | 5 | 5 | 5 |
| Dioctyl phthalate | 15 | 15 | 15 | 15 |
| Flame-proofing plasticiser | 5 | 5 | 5 | 5 |
| Antichlor stabiliser | 3 | 3 | 3 | 3 |
| Titanium oxide | 15 | 15 | 15 | 15 |
| Flame-proofing filler | 16 | 16 | 16 | 16 |
| Epikote resin type 828 or 815 (SHELL) | 3 | 3 | 3 | 3 |

TABLE I-continued

| | I (%) | II (%) | III (%) | IV (%) |
|---|---|---|---|---|
| Phenolic resin 4958 TX | 3 | 3 | 3 | 3 |

Only mixtures I, II and III, wherein the quantity of vinyl acetochloride was less than the quantity of polyvinyl chloride, were satisfactory. Mixture IV led to a final product containing bubbles, and the adhesion of the thermo-self-adhesive joining material to the sandstone and to the supplementary support was deficient.

EXAMPLES 3 TO 6

Composite materials in accordance with the present invention were obtained from rectangular ceramic tiles, with a 2mm thick cork plate as supplementary support.

The following thermo-self-adhesive joining mixtures were used:

EXAMPLE 3

| | |
|---|---|
| Powdered polyvinyl chloride | 35% |
| Dioctyl phthalate | 15% |
| Dioctyl adipate | 5% |
| Flame-proofing plasticiser | 5% |
| Antichlor stabiliser | 3% |
| Titanium oxide (rutile) | 15% |
| Flame-proofing filler | 15% |
| Epikote resin | 4% |
| Versamide resin 140 | 3% |
| | 100% |

This mixture was heated at a temperature of 160° to 165°C for 25 minutes. The product was of excellent quality. The pot life of this thermo-self-adhesive joining mixture was several days (the pot life is the period of time for which the mixture of ingredients will keep at ambient temperature before thickening appreciably).

EXAMPLE 4

| | |
|---|---|
| Powdered polyvinyl chloride | 35% |
| Dioctyl phthalate | 15% |
| Dioctyl adipate | 5% |
| Flame-proofing plasticiser | 5% |
| Antichlor stabiliser | 3% |
| Titanium oxide (rutile) | 15% |
| Flame-proofing filler | 12% |
| Epikote resin | 5% |
| Polyisocyanate resin type Desmodur AP | 5% |
| | 100% |

This mixture was heated at 165°C for 20 minutes.

EXAMPLE 5

| | |
|---|---|
| Powdered polyvinyl chloride | 35% |
| Dioctyl phthalate | 15% |
| Dioctyl adipate | 5% |
| Flame-proofing plasticiser | 5% |
| Antichlor stabiliser | 3% |
| Titanium oxide (rutile) | 15% |
| Flame-proofing filler | 13% |
| Epikote resin | 6% |
| Dicyanodiamide S.A. | 3% |
| | 100% |

This mixture was heated at 160°C for 30 minutes.

EXAMPLE 6

| | |
|---|---|
| Powdered polyvinyl chloride | 35% |
| Dioctyl phthalate | 15% |
| Dioctyl adipate | 5% |
| Flame-proofing plasticiser | 5% |
| Antichlor stabiliser | 3% |
| Titanium oxide (rutile) | 15% |
| Flame-proofing filler | 13.8% |
| Epikote resin | 5% |
| Isobutyl methacrylate | 3% |
| Di-tert-butyl peroxide | 0.2% |
| | 100% |

This mixture was heated at 170°C for 20 minutes.

EXAMPLES 7 TO 9

In Examples 1 to 6 the thermo-self-adhesive joining mixture was in the form of a plastisol, that is a product which is fluid at ambient temperature. It is also possible to use a solid thermo-self-adhesive joining mixture, for example, if the mixture is derived from nitrile rubber or if the mixture is derived from polyvinyl chloride and has been brought into a gelled form. This has been effected in Examples 7, 8 and 9.

EXAMPLES 7 AND 8

A nitrile rubber or a nitrile-polyvinyl chloride (type Butacril Z 70) rubber was used.

The rubber was mixed in a cylinder mixer (or an internal mixer of the BAMBURY type) at a temperature of 70° to 80°C, and the plasticisers, fillers, epoxide resin, phenolic (or other) resin were gradually added.

By calandering, a plastic sheet was obtained which was used as the thermo-self-adhesive joining mixture. This mixture was heated in the mold to a temperature of about 175°C for 10 to 30 minutes.

The following are two compositions for these thermo-self-adhesive sheets:

| | |
|---|---|
| Nitrile rubber with 38–40% acrylonitrile | 20% |
| Dioctyl phthalate | 7.5% |
| Flame-proofing plasticiser (chlorinated paraffin) | 2% |
| Flame-proofing filler | 37% |
| Titanium oxide | 15% |
| Zinc oxide | 5% |
| Lithopone | 5% |
| Sulphur | 0.2% |
| Tetramethyl thiuram disulphide (TMTD) | 0.3% |
| Epikote 828 or 815 | 3% |
| Phenolic resin 4958 TX | 5% |
| | 100% |

| | |
|---|---|
| Nitrile PVC (type butacril X 70 with 30% PVC) | 20% |
| Dioctyl phthalate | 7.5% |
| Flame-proofing plasticiser (chlorinated paraffin) | 2% |
| Flame-proofing filler | 37% |
| Titanium oxide | 15% |
| Zinc oxide | 5% |
| Lithopone | 5% |
| Sulphur | 0.2% |
| Tetramethyl thiuram disulphide (TMTD) | 0.3% |
| Epikote 828 or 815 | 3% |
| Phenolic resin 4958 TX | 5% |
| | 100 |

EXAMPLE 9

A thermo-self-adhesive joining mixture in the form of a pre-gelled paste was prepared from the following mixture:

| | |
|---|---|
| Powdered PVC (suspension type) | 15% |
| Powdered PVC (emulsion type) | 15% |
| Dioctyl phthalate | 18% |

-continued

| | |
|---|---|
| Dioctyl adipate | 5% |
| Flame-proofing plasticiser (chlorinated paraffin) | 5% |
| Antichlor stabiliser | 4% |
| Titanium oxide (rutile) | 15% |
| Flame-proofing filler | 15% |
| Epikote resin type 828 | 3% |
| Phenolic resin 4958 TX | 5% |
| | 100% |

The mixture was poured onto a metal ribbon heated to a temperature of 80° to 100°C, the thickness of the resulting layer being adjusted to about 1.5 to 2 mm. Pre-gelling was rapid (about 1 to 2 minutes), and the pre-gelled ribbon was cut into plates which were placed in the mold on the tiles, as described above.

The reaction temperature was about 175° to 180°C, and the reaction time was 10 to 30 minutes.

I claim:

1. A prefabricated tile panel comprising:

1. a support sheet of asbestos-coated polyvinyl chloride;

2. a plurality of spaced apart tile; and

3. means for bonding said tile to one another and to said support sheet, said means being a mixture comprising:

a. 1 to 10% by weight of a substantially stoichiometric mixture of at least one epoxide resin and at least one product selected from the group consisting of phenolic resins, polyamides, polyamines, polyisocyanates, dicyandiamines, and acrylics; and b. 10 to 50% by weight of at least one polymer selected from the group consisting of polyvinylchloride, the poly-vinylchloride-acetate and nitrile rubbers, c. the balance, materials comprising plasticizer, fire retardant, pigment or filler.

2. A panel according to claim 1, wherein the mixture contains from 10 to 50% of poly-vinylchloride.

3. A panel according to claim 1, wherein the mixture contains from 10 to 50% of a mixture of poly-vinylchloride and the poly-vinylchloride acetate.

4. A panel according to claim 1, wherein the mixture contains from 10 to 50% of nitrile rubber.

5. A panel according to claim 1, wherein the mixture comprises about 35% of powdered poly-vinylchloride, about 15% of dioctyl phthalate, about 5% of diocyl adipate, about 5% of fire-resistant plasticizer, about 3% of antichlorine stabilizer, about 15% of titanium oxide, about 15% of fire resistant filler, about 3% of an epicote resin, and about 3% of a phenolic resin 49.58, all percentages being by weight.

6. A panel according to claim 1, wherein the tiles comprise a material selected from the group consisting of sandstone, earthenware, baked earth, glass, ceramic, glazed ceramic, aluminum and stainless steel.

* * * * *